US008355661B2

(12) United States Patent
Kim et al.

(10) Patent No.: US 8,355,661 B2
(45) Date of Patent: Jan. 15, 2013

(54) FUSING DEVICE INCLUDING RESISTIVE HEATING LAYER AND IMAGE FORMING APPARATUS INCLUDING THE FUSING DEVICE

(75) Inventors: Dong-earn Kim, Seoul (KR); In-taek Han, Seoul (KR); Ha-jin Kim, Hwaseong-si (KR); Sang-soo Jee, Hwaseong-si (KR); Sang-eui Lee, Hwaseong-si (KR)

(73) Assignee: Samsung Electronics Co., Ltd. (KR)

( * ) Notice: Subject to any disclaimer, the term of this patent is extended or adjusted under 35 U.S.C. 154(b) by 275 days.

(21) Appl. No.: 12/853,569

(22) Filed: Aug. 10, 2010

(65) Prior Publication Data

US 2011/0044739 A1 Feb. 24, 2011

(30) Foreign Application Priority Data

Aug. 20, 2009 (KR) ..... 10-2009-0077162
Jun. 16, 2010 (KR) ..... 10-2010-0057120

(51) Int. Cl.
*G03G 15/20* (2006.01)

(52) U.S. Cl. ..... 399/330; 399/329; 219/216

(58) Field of Classification Search ..... 399/122, 399/329–330; 219/216
See application file for complete search history.

(56) References Cited

U.S. PATENT DOCUMENTS

| | | | | | |
|---|---|---|---|---|---|
| 4,395,109 | A | * | 7/1983 | Nakajima et al. | 219/216 |
| 4,628,183 | A | * | 12/1986 | Satomura | 219/216 |
| 4,724,305 | A | * | 2/1988 | Iimura et al. | 219/469 |
| 4,820,904 | A | | 4/1989 | Urban | |
| 4,888,464 | A | * | 12/1989 | Shibata et al. | 219/216 |
| 5,532,807 | A | * | 7/1996 | Takemoto | 399/335 |
| 5,557,370 | A | | 9/1996 | Kinoshita | |
| 5,812,906 | A | * | 9/1998 | Staudenmayer et al. | 399/69 |
| 6,122,480 | A | | 9/2000 | Hwang | |
| 6,665,504 | B2 | * | 12/2003 | Lee et al. | 399/90 |
| 2011/0116850 | A1 | * | 5/2011 | Lee et al. | 399/333 |
| 2011/0222932 | A1 | * | 9/2011 | Hayase et al. | 399/329 |

FOREIGN PATENT DOCUMENTS

| | | |
|---|---|---|
| GB | 2 290 259 A | 12/1995 |
| JP | 61148469 A | 7/1986 |

OTHER PUBLICATIONS

Extended European Search Report for Application No. 10172341.9-2209 dated Dec. 8, 2010.

* cited by examiner

*Primary Examiner* — David Gray
*Assistant Examiner* — G. M. Hyder
(74) *Attorney, Agent, or Firm* — Cantor Colburn LLP

(57) ABSTRACT

A fusing device includes; a heating member having a resistive heating layer constituting an outermost portion of the heating member, a nip forming member facing the heating member to form a fusing nip therewith, and a plurality of current supplying electrodes which contact an outer circumference of the resistive heating layer to supply electrical current to the resistive heating layer.

23 Claims, 8 Drawing Sheets

FUSING DEVICE INCLUDING RESISTIVE HEATING LAYER AND IMAGE FORMING APPARATUS INCLUDING THE FUSING DEVICE

CROSS-REFERENCE TO RELATED APPLICATIONS

This application claims priority to Korean Patent Applications No. 10-2009-0077162, filed on Aug. 20, 2009, and No. 10-2010-0057120, filed on Jun. 16, 2010, and all the benefits accruing therefrom under 35 U.S.C. §119, the contents of which in their entirety are herein incorporated by reference.

BACKGROUND

1. Field

One or more embodiments of the present disclosure relate to a fusing device having a resistive heating layer and an image forming apparatus including the fusing device.

2. Description of the Related Art

Electrophotographic image forming apparatuses typically supply a toner to an electrostatic latent image formed on an image receiving body to form a visible toner image on the image receiving body, transfer the toner image onto a printing medium, and fuse the transferred toner image onto the printing medium. The toner is typically fabricated by adding various functional additives to a base resin. The fusing process typically includes heating and compressing the toner. A large amount of energy is consumed during the fusing process in a typical electrophotographic image forming apparatus.

A fusing device typically includes a heating roller and a compressing roller that are engaged to each other to form a fusing nip. The heating roller may be heated by a heating source such as a halogen lamp or a resistive heating layer. During printing, a medium to which the toner image is transferred is transmitted through the fusing nip, where heat and pressure are then applied to the toner image.

SUMMARY

One or more embodiments of the present disclosure include a fusing device including a resistive heating layer, in which a path through which electrical current flows in the resistive heating layer may be reduced, the electric current may be directly supplied to the resistive heating layer via a surface of the resistive heating layer, and a heating range on the surface of the resistive heating layer may be adjusted.

One or more embodiments of the present disclosure include an image forming apparatus including the fusing device.

Additional aspects will be set forth in part in the description which follows and, in part, will be apparent from the description, or may be learned by practice of the presented embodiments.

According to one or more embodiments of the present disclosure, a fusing device includes; a heating member including a resistive heating layer constituting an outermost portion of the heating member, a nip forming member facing the heating member to form a fusing nip, and a plurality of current supplying electrodes which contact an outer circumference of the resistive heating layer to supply electrical current to the resistive heating layer.

In one embodiment, the resistive heating layer may include a base material, and a conductive filler distributed in the base material.

In one embodiment, the current supplying electrodes may generate electrical current flow on the resistive heating layer in a circumferential direction.

In one embodiment, the current supplying electrodes may include; a plurality of boundary electrodes, to which a first voltage is applied, defining a heating region of the resistive heating layer, contacting an outer circumference of the resistive heating layer in a state of separating from each other in a proceeding direction of the heating member; and a potential difference forming electrode, to which a second voltage is applied, contacting the outer circumference of the resistive heating layer between the plurality of boundary electrodes.

In one embodiment, the heating region may include a region of the resistive heating layer except for a portion corresponding to the fusing nip.

In one embodiment, the first voltage may be a ground voltage.

in one embodiment, a plurality of potential difference forming electrodes may be located between the plurality of boundary electrodes, and the fusing device may further include a regulating unit for regulating the second voltage applied to the plurality of potential difference forming electrodes.

In one embodiment, the plurality of boundary electrodes may have lengths corresponding to a width of the resistive heating layer, and the plurality of potential difference forming electrodes may have different lengths from each other, respectively. In one embodiment, the plurality of potential difference forming electrodes may selectively contact the outer circumference of the resistive heating layer. In one embodiment, the fusing device may further include a regulating unit for regulating the second voltage that is applied to the plurality of potential difference forming electrodes.

In one embodiment, the plurality of boundary electrodes may include; a plurality of first boundary electrodes having a first length, and a plurality of second boundary electrodes having a second length, and the potential difference forming electrodes may include a first potential difference forming electrode and a second potential difference forming electrode which are respectively located between the plurality of first boundary electrodes and between the plurality of second boundary electrodes and respectively have a first length and a second length.

In one embodiment, the plurality of first and second boundary electrodes and the first and second potential difference forming electrodes may selectively contact the outer circumference of the resistive heating layer. In one embodiment, the fusing device may further include a regulating unit which regulates the first and second voltages that are applied to the plurality of first and second boundary electrodes and the first and second potential difference forming electrodes. In one embodiment, the plurality of boundary electrodes may include a plurality of first boundary electrodes and a plurality of second boundary electrodes which are separated from each other and have lengths corresponding to a width of the resistive heating layer, and the potential difference forming electrodes may include a first potential difference forming electrode and a second potential difference forming electrode which are respectively located between the plurality of first boundary electrodes and between the plurality of second boundary electrodes and have different lengths from each other. In one embodiment, the first and second potential difference forming electrodes may selectively contact the surface of the resistive heating layer. In one embodiment, the fusing device may further include a regulating unit which regulates the second voltage applied to the first and second potential difference forming electrodes.

In one embodiment, the current supplying electrodes may further include an adjusting electrode disposed between the potential difference forming electrode and the boundary electrodes to selectively apply a voltage of substantially the same electrical potential as that of the potential difference forming electrode to the outer circumference of the resistive heating layer. In one embodiment, the adjusting electrode may selectively contact the outer circumference of the resistive heating layer.

In one embodiment, the heating member may include a cylinder shaped core which supports the resistive heating layer thereon. In one embodiment, the heating member may include a flexible belt shaped core which supports the resistive heating layer thereon.

According to one or more embodiments of the present disclosure, an image forming apparatus includes; a printing unit which forms a toner image on a surface of a medium, such as paper, and a fusing device which fuses the toner image on the paper using heat and pressure.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
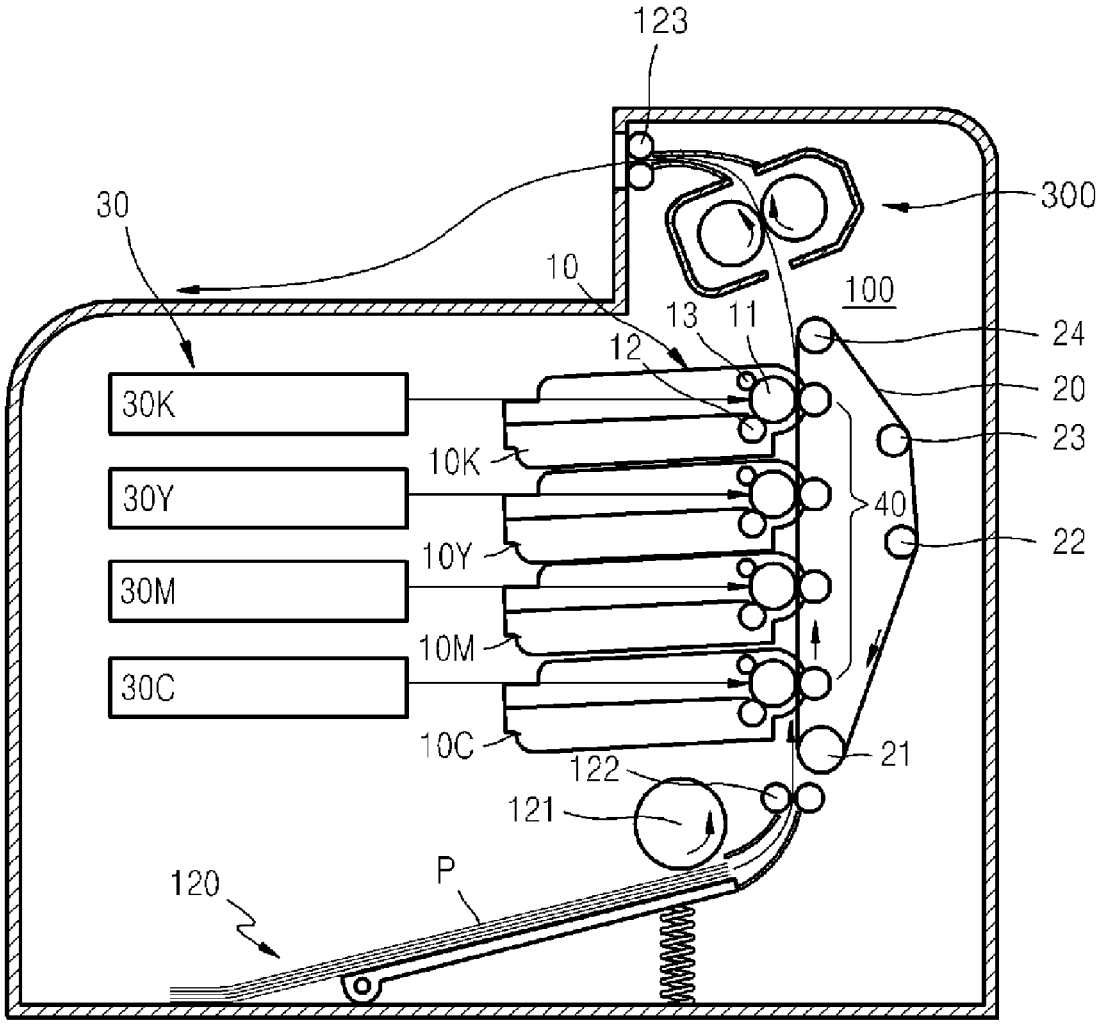
FIG. 1 is a block diagram of an embodiment of an image forming apparatus according to the present disclosure.

Embodiments now will be described more fully hereinafter with reference to the accompanying drawings, in which embodiments are shown. These embodiments may, however, be embodied in many different forms and should not be construed as limited to the embodiments set forth herein. Rather, these embodiments are provided so that this disclosure will be thorough and complete, and will fully convey the scope of the disclosure to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a", "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another elements as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the disclosure.

All methods described herein can be performed in a suitable order unless otherwise indicated herein or otherwise clearly contradicted by context. The use of any and all examples, or exemplary language (e.g., "such as"), is intended merely to better illustrate the disclosure and does not pose a limitation on the scope thereof unless otherwise claimed. No language in the specification should be construed as indicating any non-claimed element as essential to the practice of the embodiments as used herein.

Hereinafter, the embodiments will be described in detail with reference to the accompanying drawings.

FIG. 1 is a block diagram of an embodiment of an electrophotographic image forming apparatus. The image forming apparatus illustrated in FIG. 1 is a dry electrophotographic image forming apparatus that prints color images using a dry developing agent (hereinafter, referred to as a toner).

Referring to FIG. 1, the present embodiment of an electrophotographic image forming apparatus includes a printing unit 100 for forming toner images on a surface of media, e.g., a paper P. The printing unit 100 includes an exposure unit 30, a developer 10, and a transfer unit. Hereinafter, four developers 10 to receive color toners, cyan (C), magenta (M), yellow (Y), and black (K), respectively are indicated as developers 10C, 10M, 10Y, and 10K, respectively. Also, four exposure units 30 corresponding to the developers 10C, 10M, 10Y, and 10K are indicated as exposure units 30C, 30M, 30Y, and 30K, respectively.

Each of the developers 10C, 10M, 10Y, and 10K includes a photosensitive drum 11 which functions as an image receiving body on which an electrostatic latent image is formed, and a developing roller 12 for developing the electrostatic latent image. A charging bias is applied to a charging roller 13 in order to charge an outer circumference of the photosensitive drum 11 with a substantially uniform electrical potential. Alternative embodiments include configurations wherein, a corona charger (not shown) may be used instead of the charging roller 13. The developing roller 12 supplies toner to the photosensitive drum 11 by attaching the toner onto an outer circumference of the developing roller 12. A developing bias is applied to the developing roller 12 to supply the toner to the photosensitive drum 11. Although not shown in the drawings, each of the developers 10C, 10M, 10Y, and 10K may further include a supplying roller which attaches toner onto the developing roller 12, a regulating unit which regulates the amount of toner attached onto the developing roller 12, and an agitator (not shown) which conveys toner received in a corresponding one of the developers 10C, 10M, 10Y, or 10K toward the supplying roller and/or the developing roller 12. In addition, each of the developers 10C, 10M, 10Y, and 10K may further include a cleaning blade which removes toner remaining on the outer circumference of the photosensitive drum 11 before charging the photosensitive drum 11, and a receiving space for accommodating the removed toner.

The exposure units 30C, 30M, 30Y, and 30K scan light that correspond to image information of cyan, magenta, yellow and black colors, respectively, onto the photosensitive drum 11 of each of the developers 10C, 10M, 10Y, or 10K, respectively. In the present embodiment, laser scanning units ("LSUs") that use a laser diode as a light source may respectively constitute each of the exposure units 30C, 30M, 30Y, and 30K.

As an example, the transfer unit may include a paper conveying belt 20 and four transfer rollers 40. The paper conveying belt 20 faces the outer circumferences of the photosensitive drums 11, which are exposed outside the developers 10C, 10M, 10Y, and 10K; that is, a portion of the photosensitive drums 11 which extends the furthest from a remaining portion of the developer 10 may face the paper conveying belt 20. In the present embodiment, the paper conveying belt 20 is supported by supporting rollers 21, 22, 23, and 24 in order to facilitate circulation. The four transfer rollers 40 are disposed to face the photosensitive drums 11 of the developers 10C, 10M, 10Y, and 10K with the paper conveying belt 20 interposed therebetween. A transfer bias (electrical charge) is applied to the transfer rollers 40.

A process of forming a color image using the above structure will be described as follows.

The photosensitive drum 11 in each of the developers 10C, 10M, 10Y, and 10K is charged to have a substantially uniform electrical potential by applying the charging bias to the charging roller 13. The four exposure units 30C, 30M, 30Y, and 30K scan light corresponding to the image information of cyan, magenta, yellow, and black colors, respectively, onto the photosensitive drums 11 of the developers 10C, 10M, 10Y, and 10K, respectively, to form electrostatic latent images. The developing bias is then applied to the developing rollers 12. Then, toner which has been attached onto the outer circumferences of the developing rollers 12 is transferred onto the electrostatic latent images so that toner images of cyan, magenta, yellow, and black colors are formed on the photosensitive drums 11 of the developers 10C, 10M, 10Y, and 10K.

A medium to which the toner is to be applied, for example, paper P, is drawn from a cassette 120 by a pickup roller 121. The paper P is induced onto the paper conveying belt 20 by conveying rollers 122. In the present embodiment, the paper P is adhered to the paper conveying belt 20 due to an electrostatic force and is conveyed at the same velocity as a traveling velocity of the paper conveying belt 20.

For example, a front edge of the paper P reaches a transfer nip at the same time as when a front edge of the toner image of cyan (C) color, which is formed on the outer circumference of the photosensitive drum 11 in the developer 100, reaches the same transfer nip; the transfer nip in the present embodiment is formed at the region where the photosensitive drum 11 faces the transfer roller 40. When the transfer bias is applied to the transfer roller 40 corresponding to the photosensitive drum 11 corresponding to the toner image of cyan (C) color, the toner image formed on the photosensitive drum 11 is transferred onto the paper P. As the paper P is conveyed through the image forming apparatus, the toner images of magenta M, yellow Y, and black K colors formed on the photosensitive drums 11 of the developers 10M, 10Y, and 10K are sequentially transferred onto the paper P and overlap each other, and accordingly, a color toner image may be formed on the paper P.

While passing through the image forming apparatus, the color toner image formed on the paper P is maintained on the surface of the paper P due to static electricity. A fusing device 300 fuses the color toner image to the paper P using heat and pressure. The paper P on which the color toner image is fused is discharged out of the image forming apparatus by a discharging roller 123.

Figure 2:
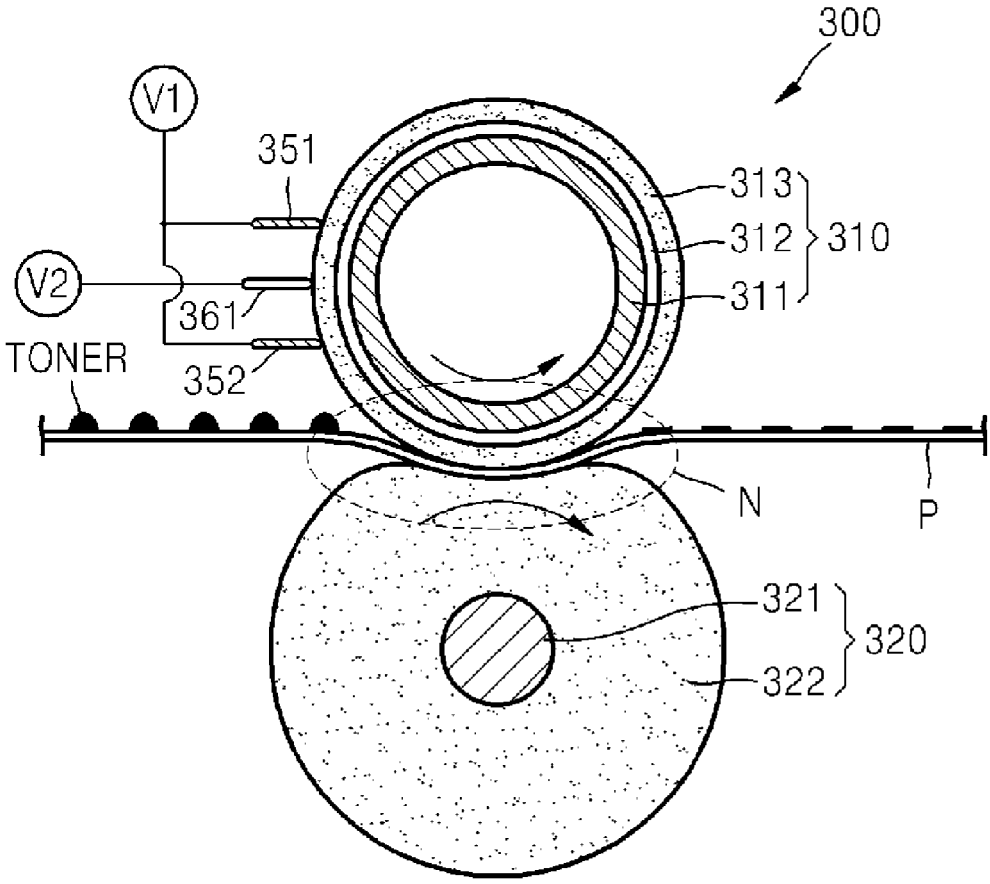
FIG. 2 is a cross-sectional view of an embodiment of a fusing device according to the present disclosure.
Figure 3:
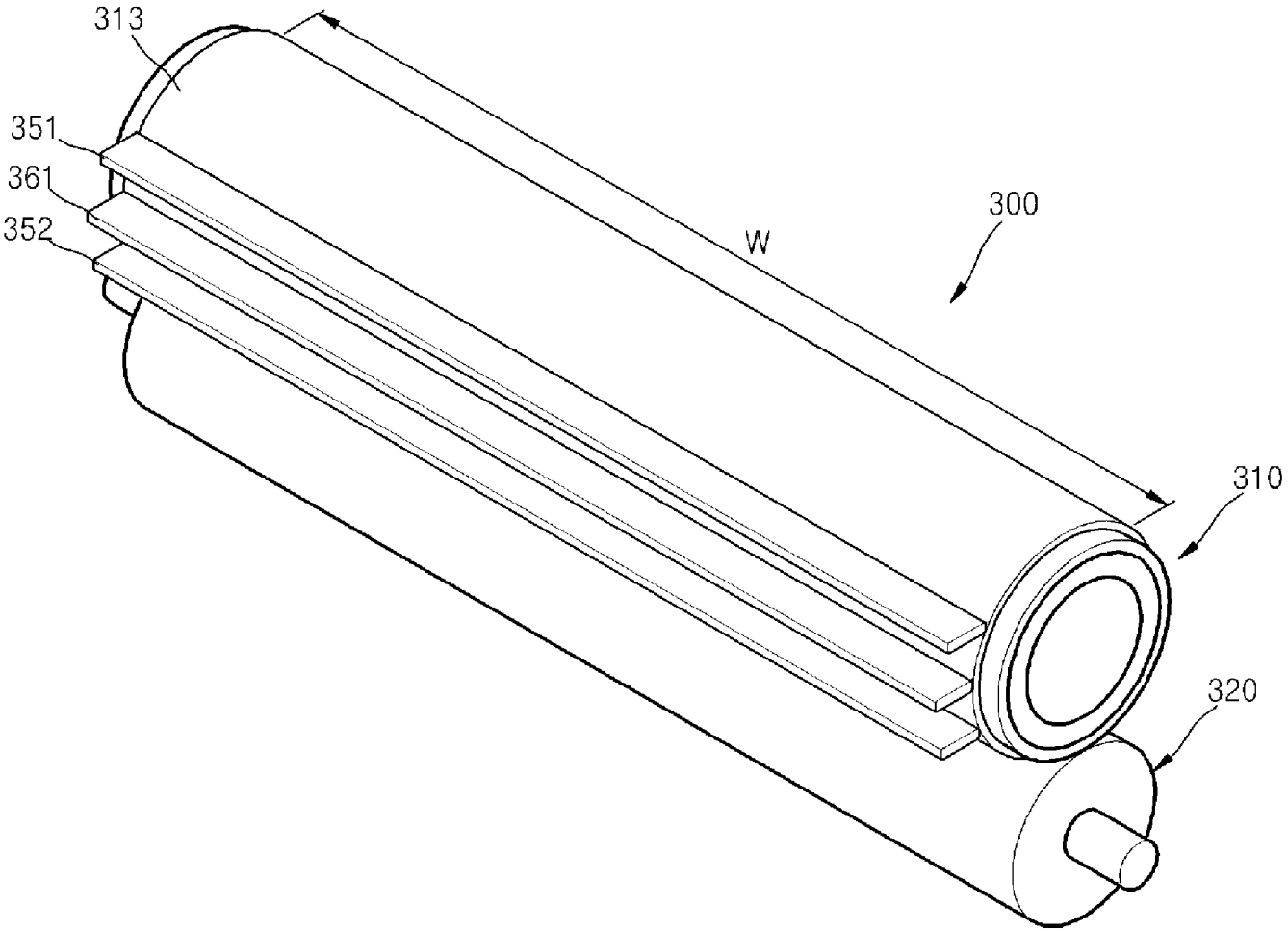
FIG. 3 is a front perspective view of the fusing device illustrated in FIG. 2.

FIG. 2 is a cross-sectional view of the fusing device 300 used in the image forming apparatus illustrated in FIG. 1, and FIG. 3 is a front perspective view of the embodiment of the fusing device 300 illustrated in FIG. 2. Referring to FIGS. 2 and 3, the present embodiment of a fusing device 300 includes a heating member 310 formed in a roller shape, and a nip forming member 320 that is engaged with the heating member 310 so as to form a fusing nip N. The nip forming member 320 may be formed in a roller shape, in which an elastic layer 322 surrounds a metal core 321. The heating member 310 and the nip forming member 320 are engaged with each other by a bias unit, which is not shown, for example, the bias unit may be a spring and may apply a biasing force to both the heating member 310 and the nip forming member 320. The nip forming member 320 may also be referred to as a compressing member since it compresses the heating member 310. When a part of the elastic layer 322 of the nip forming member 320 is deformed by the heating member 310, the fusing nip N is formed through which heat is transferred from the heating member 310 to the toner on the paper P.

The heating member 310 includes a core 311 and a resistive heating layer 313. In one embodiment, the core 311 may be cylindrically shaped. If the core 311 is formed of a metallic material, an electrical insulating layer 312 may be disposed between the resistive heating layer 313 and the core 311. In one embodiment, the core 311 may be formed of a high heat-resistant plastic that has excellent mechanical properties at high temperatures, for example, polyphenylene sulfide ("PPS"), polyamide-imide, polyimide, polyketone, polyphthalamide ("PPA"), polyether-ether-ketone ("PEEK"), polythersulfone ("PES"), or polyetherimide ("PEI"). The core 311 may be formed of any material whose mechanical properties may be maintained at a temperature at which the fusing device 300 is usually used. If a non-conductive material such as a high heat-resistant plastic is used as the core 311, the insulating layer 312 may be omitted. The insulating layer 312 may be formed of polymers having electrically-insulating properties. In addition, a high heat-resistant plastic also may be used to form the insulating layer 312. A sponge-type or a foam-type polymer may be used to form the insulating layer 312 so that the insulating layer 312 may have a heat-insulating property in addition to an electrically-insulating property.

Figure 5:
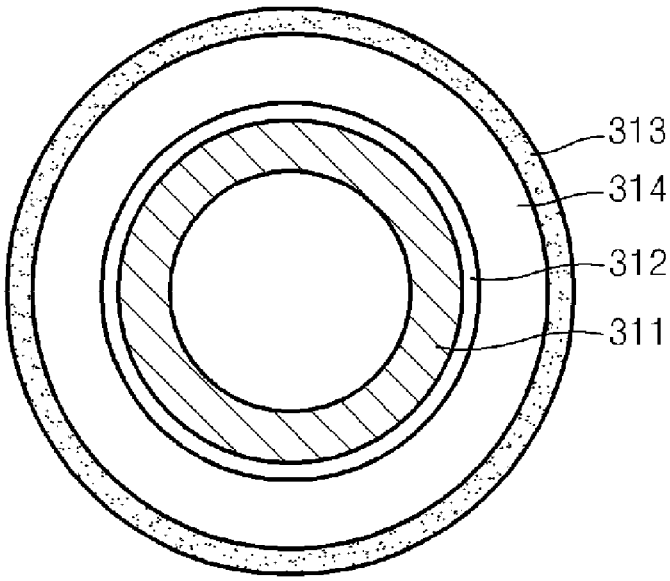
FIG. 5 is a cross-sectional view of an embodiment of a heating member including an elastic layer according to the present disclosure.

The heating member 310 may include an elastic layer. For example, a heat-resistant polymer having elasticity may be used as a base material of the resistive heating layer 313, and thus, the resistive heating layer 313 may function as the elastic layer. Alternatively, or in addition, the insulating layer 312 may be formed of a polymer having elasticity so that the insulating layer 312 functions as the elastic layer. As shown in FIG. 5, an elastic layer 314 formed of an elastic material may be disposed between the resistive heating layer 313 and the core 311.

In the fusing device 300 of the present embodiment, the heating member 310 uses the included resistive heating layer 313 as a heat source. The resistive heating layer 313 forms an outermost layer of the heating member 310. The resistive heating layer 313 is formed of a conductive material. In one embodiment the resistive heating layer 313 may be formed by dispersing a conductive filler in a base material. The base material may be any kind of material that has thermal resistance, e.g., maintains its physical characteristics, at the fusing temperature. In addition, the base material may be elastic. In this regard, a high heat-resistant elastomer, for example, a silicon rubber such as polydimethylsiloxane ("PDMS"), may be the base material of the resistive heating layer 313. In addition, embodiments include configurations wherein the base material may be a fluoropolymer-based material such as polytetrafluoroethylene ("PTFE") in order to prevent offsetting of toner, that is, to prevent toner on the paper P from being transferred onto a surface of the heating member 310.

When a voltage is applied to the resistive heating layer 313, Joule heat (also referred to as resistively generated heat or ohmically generated heat) is generated in the resistive heating layer 313. The conductive filler may include a metal-based filler such as iron, nickel, aluminum, gold, silver, or other materials with similar characteristics and/or a carbon-based filler such as carbon black, chopped carbon-fiber, carbon filament, carbon coil or other materials with similar characteristics. The metal-based filler may be formed to have various shapes, for example, needle-shaped, plate-shaped, circular shaped or various other shapes. In addition, in order to improve thermal conductivity, a metal oxide such as alumina or oxidized steel may be included in the resistive heating layer 313.

In order to form images, the fusing device 300 is heated to a temperature approximating the fusing temperature. A period between receiving a printing command and printing a first page may be reduced by reducing the time required for heating the fusing device 300 to the operational fusing temperature. In a general electrophotographic image forming apparatus, the fusing device is only heated when a printing operation is performed and does not operate in a standby mode. Therefore, when the printing operation is subsequently performed after an initial operation, time is required to heat the fusing device again. In order to reduce the time needed to re-operate the fusing device 300, in one embodiment the fusing device 300 is controlled to be maintained at a preheating temperature in the standby mode. A preheating temperature of the fusing device in the standby mode is about 150° C. to about 180° C. For example, in an image forming apparatus for printing images onto A4-sized paper, power consumption during the standby mode is about 30 W. If the time required to raise the temperature of the fusing device to the temperature at which the printing operation may be performed is sufficiently reduced, the preheating in the standby mode may be not performed and therefore power consumption in the fusing device may also be reduced.

The temperature generated from the resistive heating layer 313 and the rate of increase thereof may be determined by physical properties of the resistive heating layer 313, such as its geometric dimensions, for example, thickness and length, its specific heat, and its electrical conductivity. In one embodiment, the resistive heating layer 313 may have an electrical conductivity of about $10^{-5}$ S/m or greater. In an embodiment where a voltage applied to the resistive heating layer 313 is constant, the heating member 310 may be rapidly heated at a high efficiency when the resistance of the resistive heating layer 313 is relatively small. Resistance R of a resistive material is generally proportional to a length of the resistive material, and is inversely proportional to a cross-sectional area and an electrical conductivity of the resistive material. In order to reduce the resistance of the resistive heating layer 313, the electrical conductivity may be increased. The electrical conductivity may be increased by increasing the content of conductive filler, improving the arrangement of the filler, and controlling the dispersion of the filler within the heating member 310.

In the present embodiment of a fusing device 300, a path in which electrical current flows is reduced. To this end, as shown in FIGS. 2 and 3, an electrode having a length corresponding to a width of the resistive heating layer 313 is used as a current supplying electrode which supplies electrical current to the resistive heating layer 313 (as used herein the length of the electrode refers to a longest axis thereof and a width of the resistive heating layer 313 refers to a longest axis thereof). According to the above structure, the electrical current flows along a circumferential direction of the resistive heating layer 313, and accordingly, the path in which the electrical current flows is reduced.

In addition, the electrical current is supplied to the outer circumferential surface of the resistive heating layer 313 so that the heat generated from the resistive heating layer 313 may be directly supplied to the fusing nip N without being lost during the process of heating the core 311. To do this, as shown in FIGS. 2 and 3, current supplying electrodes may contact the outer circumference of the resistive heating layer 313, which will contact the paper P.

Figure 4:
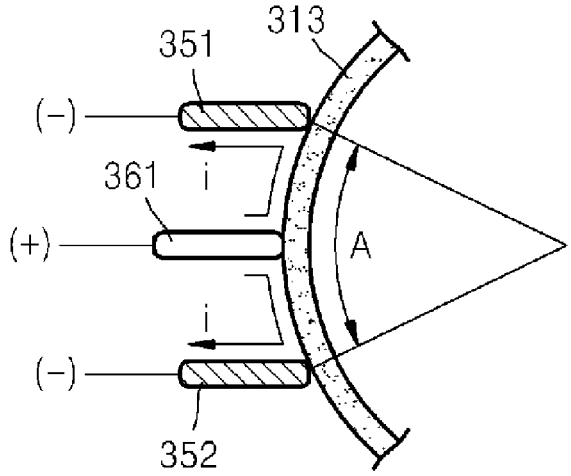
FIG. 4 is a diagram illustrating a heating range on the embodiment of a fusing device illustrated in FIG. 2.

The current supplying electrodes may include boundary electrodes 351 and 352, and a potential difference forming electrode 361. The boundary electrodes 351 and 352 are separated from each other in a circumferential direction of the heating member 310, and contact the outer circumference of the resistive heating layer 313. In one embodiment, the boundary electrodes 351 and 352 may have the same electrical potential V1 as each other. In the present embodiment, the potential difference forming electrode 361 is located between the two boundary electrodes 351 and 352, and contacts the outer circumference of the resistive heating layer 313. An electrical potential V2 of the potential difference forming electrode 361 is different from the electrical potential V1 of the boundary electrodes 351 and 352. Accordingly, a potential difference exists between the potential difference forming electrode 361 and the boundary electrodes 351 and 352. Therefore, electrical current flows along the surface of the resistive heating layer 313 due to the potential difference. For example, as shown in FIG. 4, when equal negative voltages are applied to the boundary electrodes 351 and 352 and a positive voltage is applied to the potential difference forming electrode 361, the electrical current i only flows in a heating region A, that is, a region partitioned by the boundary electrodes 351 and 352 and in which the potential difference forming electrode 361 is disposed. Since the electrical potentials of the boundary electrodes 351 and 352 are substantially equal to each other, a potential difference is not formed in a remaining region other than the region A, and accordingly, the electrical current does not significantly flow in the remaining region. When a ground voltage is applied to the boundary electrodes 351 and 352, such as when a user contacts the surface of the resistive heating layer 313, a problem such as an electrical shock does not occur except for if the contact occurs at the region A directly or contacts the region A via a conductive material. Therefore, there is no need to electrically isolate the surface of the resistive heating layer 313 from an outer portion, except for the region A. In the region A, heat is generated due to the current i flowing on the surface of the resistive heating layer 313 in the circumferential direction of the heating member 310. As the heating member 310 rotates, the heated region A reaches the fusing nip N, and the heat is transferred from the surface of the resistive heating layer 313 directly to the paper P and the toner that is attached onto the paper P by the electrostatic force.

As an example, in one embodiment the heating member 310 formed as a roller has a diameter of about 30 mm, and the resistive heating layer 313 has a thickness of about 0.1 mm and an electrical conductivity of about 7 S/m. As a comparative example, when an electrode (not shown) is disposed on the heating member 310 so that the current flows in a width direction W of the resistive heating layer 313 to generate a potential difference of about 220 V, the resistive heating layer 313 has a resistance of about 2.5 kΩ. As shown in FIG. 2, the angle between the boundary electrodes 351 and 352 is about 45° in the circumferential direction of the heating member 310, and the potential difference forming electrode 361 is disposed between the boundary electrodes 351 and 352, although alternative embodiments include alternative configurations wherein the boundary electrodes 351 and 352 are arranged at greater or lesser angles with respect to the potential difference forming electrode 361. When the potential difference of about 220 V is generated between the boundary electrodes 351 and 352 and the potential difference forming electrode 361, an energy of about 1300 W is generated in the heating region A. In such an embodiment, the resistance of the resistive heating layer in the heating area is about 50Ω which is about 1/50 of the resistance in the comparative example. The low resistance means that a lot of current may be supplied through the resistive heating layer 313 under the same voltage, and thus, the resistive heating layer 313 of the fusing device 300 according to the current embodiment may be formed of a material having a relatively low electrical conductivity. Therefore, the resistive heating layer 313 may be formed of a wide range of materials, and accordingly, a material having excellent mechanical characteristics while having low electrical conductivity may be used to form the resistive heating layer 313.

As described above, the boundary electrodes 351 and 352 and the potential difference forming electrode 361 are disposed so that the current may flow on the surface of the resistive heating layer 313 along the circumferential direction of the resistive heating layer 313, and accordingly, the heating member 310 may generate heat rapidly at high efficiencies with regard to given conditions of the conductive filler content. Therefore, the content of the conductive filler in the resistive heating layer 313 may be adjusted to be within a range in which the physical properties of the resistive heating layer 313, such as solidity, tensile strength, and compressive strength, may be suitable for the fusing device 300 while reducing degradation of heating characteristics of the resistive heating layer 313. In addition, the amount of conductive filler may be adjusted so that the physical properties of the resistive heating layer 313 may be maintained within a range in which general fabrication methods, such as injection, extrusion, or spray coating may be used to fabricate the resistive heating layer 313 while maintaining the heating properties of the resistive heating layer 313.

In addition, since the heat generated from the resistive heating layer 313 is directly transferred to the fusing nip N through the surface of the resistive heating layer 313, a loss of heat transferred to the core 311 may be reduced, thereby improving the thermal efficiency of the resulting device. Also, since the heating region of the resistive heating layer 313 may be heated so that the temperature only rapidly rises within the heating region, the fusing operation may be performed at a high speed. Since the electrodes for supplying electrical current to the resistive heating layer 313 are separated from the heating member 310, the structure of the heating member 310 may be simplified and the heating member 310 may be manufactured in a simple way. In addition, the resistance of the resistive heating layer 313 may be maintained regardless of the change in the size of the heating member 310, and accordingly, the surface temperature of the heating member 310 may be adjusted easily. That is, when the distance between the boundary electrodes 351 and 352 is maintained constantly even when the diameter of the heating member 310 increases, the heating region is not significantly changed and the resistance of the resistive heating layer 313 within the heating region is constantly maintained. In the fusing device 300, the portion where the fusing nip N is disposed contacts the paper P. Therefore, when the heating region is in a region of the fusing device 300 other than the fusing nip N, an electrical shock which may be caused by the leakage of current through the paper P may be prevented.

In one embodiment, a metal material having relatively high electrical conductivity may be used to form the boundary electrodes 351 and 352 and the potential difference forming electrode 361. However, the material used to form the electrodes may not be limited thereto. For example, a conductive polymer having excellent electrical conductivity such as indium tin oxide ("ITO"), which is a material widely used for forming transparent electrodes, poly-3,4-ethylenedioxythiophene ("PEDOT"), polypyrrole ("Ppy"), a carbon material such as carbon fibers, carbon nano-fiber, carbon filament, carbon coil, carbon black, other materials with similar characteristics, or a combination material thereof may be used as a material for the boundary electrodes 351 and 352 and the potential difference forming electrode 361.

Figure 6:
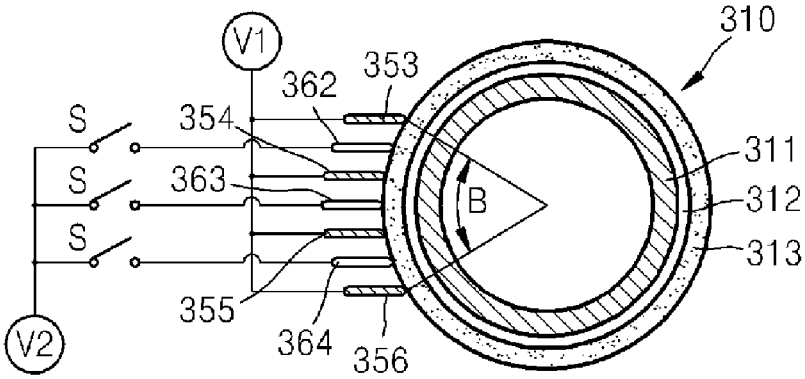
FIG. 6 is a cross-sectional view of another embodiment of a fusing device according to the present disclosure.

FIG. 6 is a cross-sectional view of another embodiment of a fusing device 310. Referring to FIG. 6, a plurality of potential difference forming electrodes 362, 363, and 364 are disposed between a plurality of boundary electrodes 353, 354, 355, and 356 to partition a heating region B into a plurality of sections. That is, the heating region B of FIG. 6 is partitioned into six sections. As described above, the heating region B may be partitioned into a plurality of sections so as to reduce a length of the path in which the electrical current flows in each of the plurality of sections and to reduce a resistance of the resistive heating layer 313. Therefore, a material having low electrical conductivity may be used to form the resistive heating layer 313. In addition, as shown in FIG. 6, a voltage V2 is selectively applied to the plurality of potential difference forming electrodes 362, 363, and 364 so as to adjust the heating amount of the resistive heating layer 313 in the heating region B. For example, the voltage V2 may be selectively applied to the plurality of potential difference forming electrodes 362 to 364 by turning on/off a plurality of regulating units S; in one embodiment the regulating units may be switches. In addition, the voltage V2 may also be selectively applied to the plurality of potential difference forming electrodes 362 to 364 by contacting/separating the plurality of potential difference forming electrodes 362 to 364 to/from the surface of the resistive heating layer 313 using an actuator (not shown). The adjustment of the heating amount may be differently performed in a full-color printing operation and a mono-color printing operation. In addition, the heating amount may be differently adjusted according to a printing speed. Alternative embodiments include configurations wherein the amount of applied heat may be adjusted according to any of a variety of variables.

Figure 7:
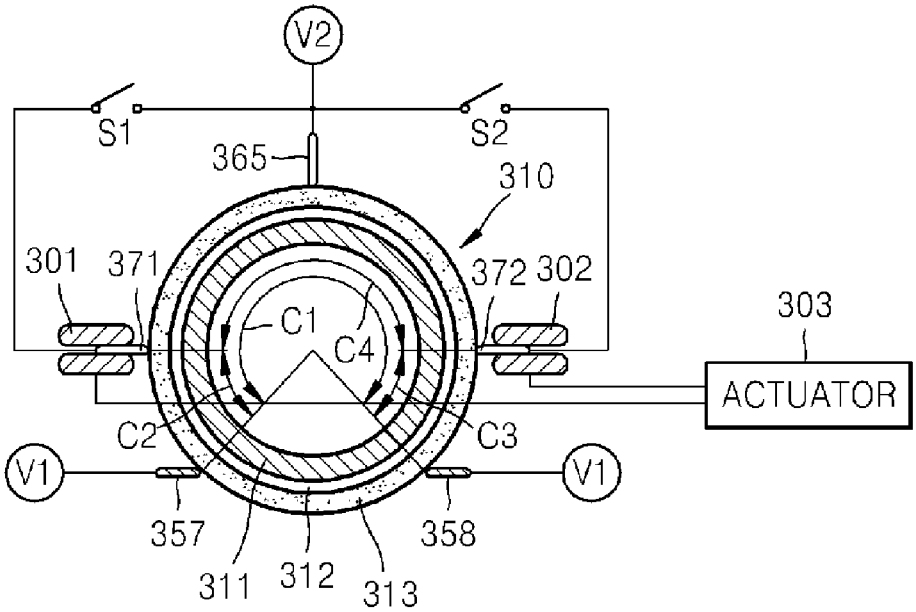
FIG. 7 is a cross-sectional view of another embodiment of a fusing device including an adjusting electrode, according to the present disclosure.

FIG. 7 is a cross-sectional view of another embodiment of a fusing device 310. Referring to FIG. 7, adjusting electrodes 371 and 372 are installed between boundary electrodes 357 and 358 and a potential difference forming electrode 365. The adjusting electrodes 371 and 372 may have substantially the same electrical potential as that of the potential difference forming electrode 365 or the boundary electrodes 357 and 358. In the embodiment shown in FIG. 7, the voltage V2 is applied to the adjusting electrodes 371 and 372, which is the same as the voltage V2 applied to the potential difference forming electrode 365. The adjusting electrodes 371 and 372 may move to a first position, at which the adjusting electrodes 371 and 372 contact the surface of the resistive heating layer 313, and a second position, at which the adjusting electrodes 371 and 372 are separated from the surface of the resistive heating layer 313. For example, the adjusting electrodes 371 and 372 may be installed on supporting members 301 and 302 respectively, and the supporting members 301 and 302 may be moved by an actuator 303. Various driving devices such as an electric motor or a solenoid may be used as the actuator 303. When the adjusting electrodes 371 and 372 are separated from the surface of the resistive heating layer 313, the heating region of the resistive heating layer 313 is a region C1 between the boundary electrodes 357 and 358. When the adjusting electrodes 371 and 372 contact the surface of the resistive heating layer 313, the heating region of the resistive heating layer 313 is a region C2 between the boundary electrode 357 and the adjusting electrode 371 and a region C3 between the boundary electrode 358 and the adjusting electrode 372, wherein the combined regions C2 and C3 may be selected to be smaller than the region C1.

Although such a configuration is not shown in the drawings, in an embodiment where the voltage V1 is applied to the adjusting electrodes 371 and 372, the heating range of the resistive layer 313 is a region C4 between the adjusting electrodes 371 and 372 when the adjusting electrodes 371 and 372 contact the surface of the resistive layer 313. Since the region C1 is greater than the region including the combined regions C2 and C3 and greater than the region C4, the temperature when the adjusting electrodes 371 and 372 contact the surface of the resistive heating layer 313 rises faster than that when the adjusting electrodes 371 and 372 are separated from the surface of the resistive heating layer 313.

According to the above described structure, the heating region may be adjusted in consideration of the fusing temperature and the printing speed. For example, since a lot of energy is required in an initial temperature rising operation for increasing the temperature of the fusing device 310 after initially turning the image forming apparatus on, the adjusting electrodes 371 and 372 contact the surface of the resistive heating layer 313 to reduce the heating region of the resistive heating layer 313 and quickly increase the temperature. In addition, when the printing operation is performed after finishing the initial temperature rising operation, one of the adjusting electrodes 371 and 372 or both of the adjusting electrodes 371 and 372 may be separated from the surface of the resistive heating layer 313 to increase the heating region and control the heating amount.

Instead of contacting/separating the adjusting electrodes 371 and 372 to/from the surface of the resistive heating layer 313, regulating units S1 and S2 may be installed to change the heating region by electrically isolating the adjusting electrodes 371 and 372 as shown in FIG. 7.

Figure 8:
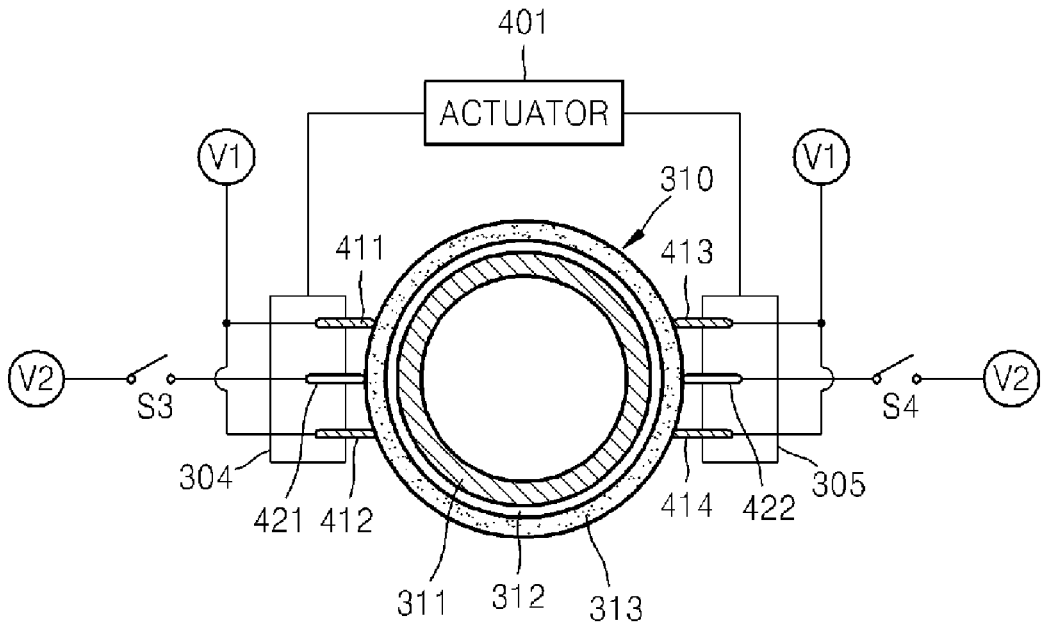
FIGS. 8 through 10 are cross-sectional views showing examples of a fusing device, in which a heating range may be determined corresponding to a width of a printing medium.

FIG. 8 is a cross-sectional view of another embodiment of a fusing device 310. Referring to FIG. 8, first boundary electrodes 411 and 412 and a first potential difference forming electrode 421 are mounted on a first supporting member 304. Second boundary electrodes 413 and 414 and a second potential difference forming electrode 422 are mounted on a second supporting member 305. An actuator 401 drives the first and second supporting members 304 and 305 to either individually or jointly contact/separate to/from the resistive heating layer 313. In FIG. 8, lengths of the first boundary electrodes 411 and 412 and the first potential difference forming electrode 421, that is, lengths in a width direction of the heating member 310, are different from the lengths of the second boundary electrodes 413 and 414 and the second potential difference electrode 422. That is, lengths of the boundary electrodes 411 to 414 and the potential difference forming electrodes 421 and 422 may vary depending on a width of the region to be heated.

For example, the lengths of the first boundary electrodes 411 and 412 and the first potential difference forming electrode 421 may correspond to a width of A4-sized paper, and the lengths of the second boundary electrodes 413 and 414 and the second potential difference forming electrode 422 may correspond to a width of A3-sized paper. When a printing operation is performed on A4-sized paper, the actuator 401 moves the first supporting member 304 toward the resistive heating layer 313 so that the first boundary electrodes 411 and 412 and the first potential difference forming electrode 421 may contact the surface of the resistive heating layer 313, and moves the second supporting member 305 apart from the resistive heating layer 313 so that the second boundary electrodes 413 and 414 and the second potential difference forming electrode 422 may be separated from the surface of the resistive heating layer 313. On the other hand, when a printing operation is performed on A3-sized paper, the actuator 401 drives the first and second supporting members 304 and 305 so that the second boundary electrodes 413 and 414 and the second potential difference forming electrode 422 may contact the surface of the resistive heating layer 313 and the first boundary electrodes 411 and 412 and the first potential difference forming electrode 421 may be separated from the surface of the resistive heating layer 313. According to the above structure, heat may be applied only to the region which is required to perform the fusing operation, and accordingly, power consumption may be reduced.

Instead of moving the first and second boundary electrodes 411 to 414 and the first and second potential difference forming electrodes 421 and 422 using an actuator 401, regulating units S3 and S4 may be installed and turned on/off.

Figure 9:
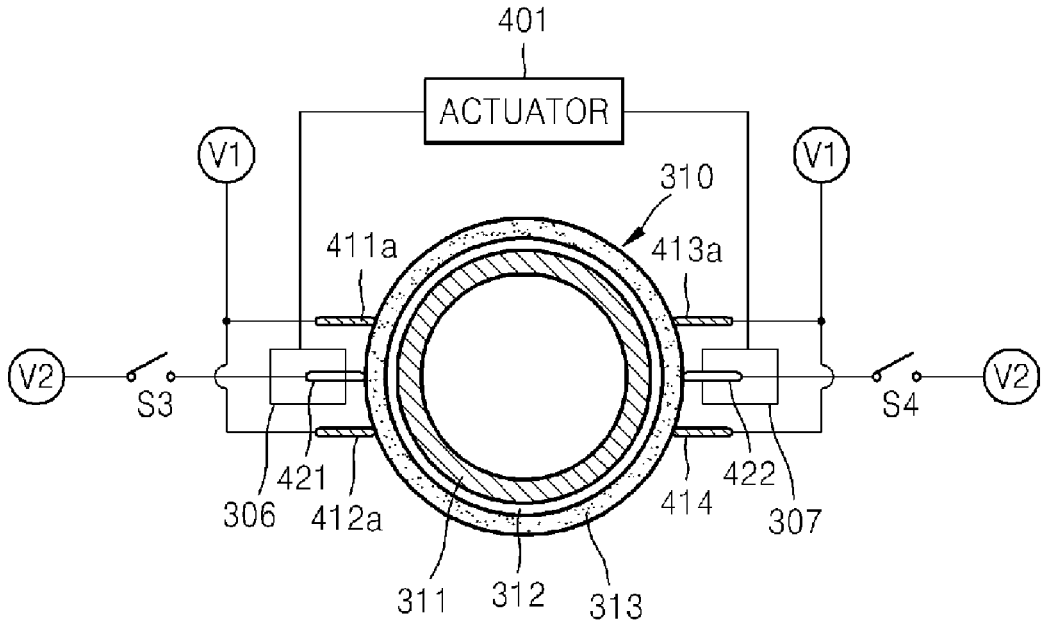

As a modified example embodiment, as shown in FIG. 9, lengths of first and second boundary electrodes 411*a*, 412*a*, 413*a*, and 414*a* may correspond to the width of the resistive heating layer 313, and lengths of the first and second potential difference forming electrodes 421 and 422 may be formed to be different from each other to correspond to a width of the region to be heated. For example, the length of the first potential difference forming electrode 421 may correspond to a width of the A4-sized paper, and the length of the second potential difference forming electrode 422 may correspond to a width of A3-sized paper. The first and second boundary electrodes 411*a* to 414*a* may be maintained continuously in contact with the surface of the resistive heating layer 313. When the A4-sized paper is used, the supporting member 306 is moved toward the resistive heating layer 313 to make the first potential difference forming electrode 421 contact the surface of the resistive heating layer 313, and the supporting member 307 is moved to be separated from the resistive heating layer 313 to make the second potential difference forming electrode 422 be spaced apart from the surface of the resistive heating layer 313 using an actuator 401. On the other hand, when the A3-sized paper is used, the second potential difference forming electrode 422 contacts the surface of the resistive heating layer 313, and the first potential difference forming electrode 421 is separated from the surface of the resistive heating layer 313 using the actuator 401. Instead of moving the first and second potential difference forming electrodes 421 and 422, the regulating units S3 and S4 may be installed in order to turn on/off the voltage V2 applied to the first and second potential difference forming electrodes 421 and 422.

Figure 10:
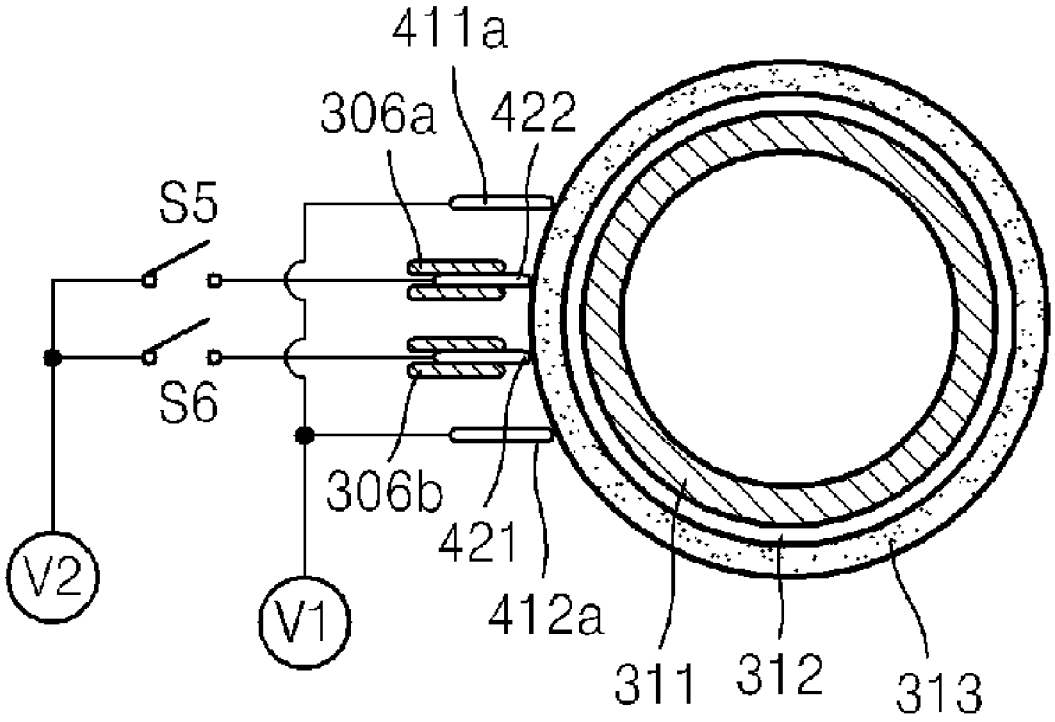

In addition, as shown in FIG. 10, in one embodiment the first and second potential difference forming electrodes 421 and 422 having different lengths from each other may be disposed between the boundary electrodes 411*a* and 412*a*. In such an embodiment, lengths of the boundary electrodes 411*a* and 412*a* correspond to the width of the resistive heating layer 313. For example, the length of the first potential difference forming electrode 421 may correspond to the width of the A4-sized paper, and the second potential difference forming electrode 422 may correspond to the width of the A3-sized paper. The boundary electrodes 411*a* and 412*a* may be maintained in a state of continuous contact with the surface of the resistive heating layer 313. In one embodiment, the first and second potential difference forming electrodes 421 and 422 may be selectively contacted/separated to/from the surface of the resistive heating layer 313 in correspondence with the width of the printing medium by moving the supporting members 306*a* and 306*b* using an actuator (not shown). Otherwise, alternative embodiments include configurations wherein the voltage V2 applied to the first and second forming electrodes 421 and 422 may be turned on/off by installing regulating units S5 and S6.

Figure 11:
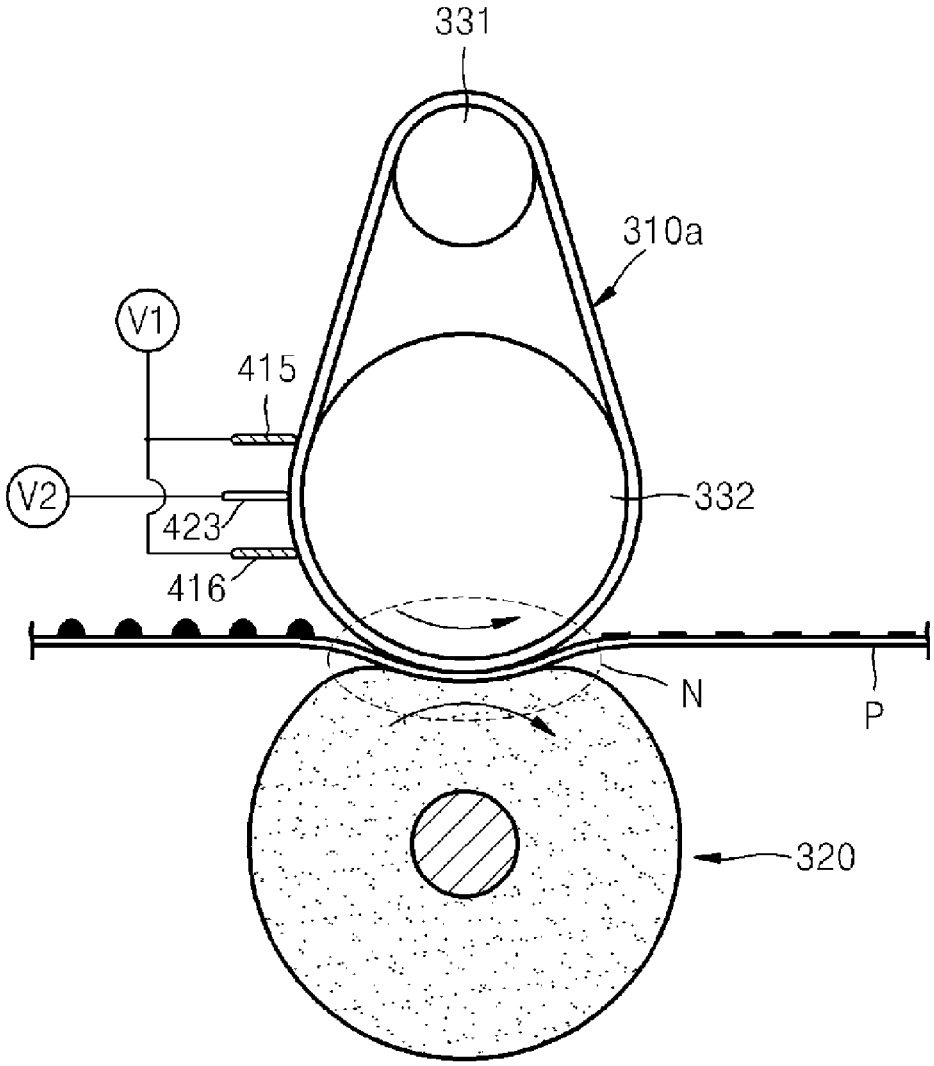
FIG. 11 is a cross-sectional view of another embodiment of a fusing device including a heating member formed as a belt, according to the present disclosure.

FIGS. 2 through 10 illustrate embodiments wherein the fusing device 300 includes the heating member 310 formed as a roller; however, alternative embodiments wherein a heating member 310*a* formed as a belt may be used in the fusing device 300 as illustrated in FIG. 11. FIG. 11 is a cross-sectional view of an embodiment of a fusing device including a heating member 310*a* formed as a belt. Referring to FIG. 11, the heating member 310*a* is supported by supporting rollers 331 and 332 in order to allow the heating member 310*a* to circulate. A nip forming member 320 faces the supporting roller 332 and the heating member 310*a* is interposed between the nip forming member 320 and the supporting roller 332 to form the fusing nip N.

Figure 12:
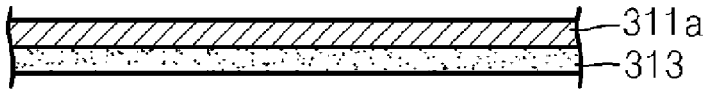
FIG. 12 is a cross-sectional view of the heating member illustrated in FIG. 11.

FIG. 12 is a cross-sectional view of an embodiment of the heating member 310*a* illustrated in FIG. 11. Referring to FIG. 12, the present embodiment of a heating member 310*a* includes a core 311*a* formed as a belt and a resistive heating layer 313. The core 311 a may be elastic to allow the heating member 310*a* to be flexibly deformed on the fusing nip N and to recover its original state after passing through the fusing nip N. For example, in one embodiment the core 311*a* may be formed of a heat-resistant polymer or a metal thin film. In particular, in one embodiment the core 311*a* may be formed as a stainless steel thin film having a thickness of about 35 μm. Since the resistive heating layer 313 is described above, a description thereof will not be repeated here.

Boundary electrodes 415 and 416 contact the resistive heating layer 313 to define the heating region, and a potential difference forming electrode 423 is disposed between the boundary electrodes 415 and 416 to generate a potential difference.

As described above, when the fusing device 300 includes the heating member 310*a* formed as a belt as illustrated in FIGS. 11 and 12, modified examples of FIGS. 3 through 10 may be applied to the fusing device 300.

It should be understood that the embodiments described therein should be considered in a descriptive sense only and not for purposes of limitation. Descriptions of features or aspects within each embodiment should typically be considered as available for other similar features or aspects in other embodiments.

What is claimed is:

1. A fusing device comprising:

a heating member comprising a resistive heating layer constituting an outermost portion of the heating member;

a nip forming member facing the heating member to form a fusing nip therewith; and a plurality of current supplying electrodes which contact an outer circumference of the resistive heating layer to supply electrical current to the resistive heating layer, wherein the current supplying electrodes generate an electrical current flow on the resistive heating layer in a circumferential direction, and wherein the current supplying electrodes comprise:

a plurality of boundary electrodes, to which a first voltage is applied, wherein the plurality of boundary electrodes define a heating region of the resistive heating layer, contact an outer circumference of the resistive heating layer, and are separated from each other in a direction of rotation of the heating member; and a potential difference forming electrode, to which a second voltage, which is different than the first voltage, is applied, wherein the potential difference forming electrode contacts the outer circumference of the resistive heating layer between the plurality of boundary electrodes.

2. The fusing device of claim 1, wherein the resistive heating layer comprises a base material and a conductive filler distributed in the base material.

3. The fusing device of claim 1, wherein the heating member comprises a cylindrically shaped core which supports the resistive heating layer thereon.

4. The fusing device of claim 1, wherein the heating member comprises a flexible belt shaped core which supports the resistive heating layer thereon.

5. The fusing device of claim 1, wherein the heating region comprises a region of the resistive heating layer excluding a portion corresponding to the fusing nip.

6. The fusing device of claim 5, wherein the first voltage is a ground voltage.

7. The fusing device of claim 5, wherein a plurality of potential difference forming electrodes all of which are supplied with the second voltage are interposed between the plurality of boundary electrodes, and the fusing device further comprises a regulating unit which regulates the second voltage applied to the plurality of potential difference forming electrodes.

8. The fusing device of claim 5, wherein the plurality of boundary electrodes have lengths corresponding to a width of the resistive heating layer, and at least two of the plurality of potential difference forming electrodes have different lengths from each other.

9. The fusing device of claim 8, wherein the plurality of potential difference forming electrodes selectively contact the outer circumference of the resistive heating layer.

10. The fusing device of claim 8, further comprising a regulating unit which regulates the second voltage applied to the plurality of potential difference forming electrodes.

11. The fusing device of claim 5, wherein the plurality of boundary electrodes comprises:

a plurality of first boundary electrodes, each of the plurality of first boundary electrodes respectively having a first length; and a plurality of second boundary electrodes, each of the plurality of second boundary electrodes respectively having a second length, and wherein the potential difference forming electrodes comprise:

a first potential difference forming electrode; and a second potential difference forming electrode which are respectively located between the plurality of first boundary electrodes and between the plurality of second boundary electrodes and have a first length and a second length, respectively.

12. The fusing device of claim 11, wherein the plurality of first boundary electrodes and the second boundary electrodes and the first potential difference forming electrodes and the second potential difference forming electrodes selectively contact the outer circumference of the resistive heating layer.

13. The fusing device of claim 11, further comprising a regulating unit which regulates the first voltage and the second voltage that are applied to the plurality of first boundary electrodes and the plurality of second boundary electrodes and the first potential difference forming electrode and the second potential difference forming electrode.

14. The fusing device of claim 5, wherein the plurality of boundary electrodes comprises:

a plurality of first boundary electrodes; and a plurality of second boundary electrodes which are separated from each other and have respective lengths corresponding to a width of the resistive heating layer, and the potential difference forming electrodes comprise:

first potential difference forming electrodes and second potential difference forming electrodes which are respectively located between the plurality of first boundary electrodes and between the plurality of second boundary electrodes and have different lengths from each other.

15. The fusing device of claim 14, wherein the first potential difference forming electrode and the second potential difference forming electrode selectively contact a surface of the resistive heating layer.

16. The fusing device of claim 14, further comprising a regulating unit which regulates the second voltage which is applied to the first potential difference forming electrode and the second potential difference forming electrode.

17. The fusing device of claim 5, wherein the current supplying electrodes further comprise an adjusting electrode disposed between the potential difference forming electrode and the boundary electrodes, wherein the adjusting electrode selectively applies a voltage of substantially a same electrical potential as that of the potential difference forming electrode to the outer circumference of the resistive heating layer.

18. The fusing device of claim 17, wherein the adjusting electrode selectively contacts the outer circumference of the resistive heating layer.

19. An image forming apparatus comprising:

a printing unit which forms a toner image on a surface of medium; and a fusing device which fuses the toner image on the medium using heat and pressure, wherein the fusing device comprises:

a heating member comprising a resistive heating layer constituting an outermost portion of the heating member;

a nip forming member which faces the heating member and forms a fusing nip therewith; and a plurality of current supplying electrodes which contact an outer circumference of the resistive heating layer and supply electrical current to the resistive heating layer, wherein the current supplying electrodes generate an electrical current flow on the resistive heating layer in a circumferential direction, and wherein the current supplying electrodes comprise:

a plurality of boundary electrodes, to which a first voltage is applied, wherein the plurality of boundary electrodes define a heating region of the resistive heating layer, contact an outer circumference of the resistive heating layer, and are separated from each other in a direction of rotation of the heating member; and a potential difference forming electrode, to which a second voltage, which is different than the first voltage, is applied, wherein the potential difference forming electrode contacts the outer circumference of the resistive heating layer between the plurality of boundary electrodes.

20. The image forming apparatus of claim 19, wherein the resistive heating layer comprises:

a base material; and a conductive filler distributed in the base material.

21. The image forming apparatus of claim 19, wherein the heating region comprises a region of the resistive heating layer excluding a portion corresponding to the fusing nip.

22. The image forming apparatus of claim 19, wherein the first voltage is a ground voltage.

23. A method of forming a fusing device, the method comprising:

providing a heating member comprising a resistive heating layer constituting an outermost portion of the heating member;

forming a fusing nip including a nip forming member facing the heating member;

contacting a plurality of current supplying electrodes with an outer circumference of the resistive heating layer; and supplying electrical current to the resistive heating layer, wherein the current supplying electrodes generate an electrical current flow on the resistive heating layer in a circumferential direction, and wherein the current supplying electrodes comprise:

a plurality of boundary electrodes, to which a first voltage is applied, wherein the plurality of boundary electrodes define a heating region of the resistive heating layer, contact an outer circumference of the resistive heating layer, and are separated from each other in a direction of rotation of the heating member; and a potential difference forming electrode, to which a second voltage, which is different than the first voltage, is applied, wherein the potential difference forming electrode contacts the outer circumference of the resistive heating layer between the plurality of boundary electrodes.

* * * * *